US006414423B2

(12) United States Patent
Shibata et al.

(10) Patent No.: US 6,414,423 B2
(45) Date of Patent: Jul. 2, 2002

(54) FLUORESCENT LAMP WITH HOLDER MADE OF RESIN

(75) Inventors: Takenori Shibata, Osaka; Toshihiro Terada, Hyogo, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/886,549

(22) Filed: Jun. 21, 2001

(30) Foreign Application Priority Data

Jun. 30, 2000 (JP) ..... 2000-199209

(51) Int. Cl.[7] ..... H01J 5/48
(52) U.S. Cl. ..... 313/318.01; 313/318.04
(58) Field of Search ..... 313/112, 25, 46, 313/318.01, 318.04, 493, 639; 65/66

(56) References Cited

U.S. PATENT DOCUMENTS 3,148,300 A * 9/1964 Graff ..... 313/112
4,745,323 A * 5/1988 Northrop et al. ..... 313/25
4,748,380 A * 5/1988 MacDonald et al. ..... 313/46
5,336,969 A * 8/1994 Weiss et al. ..... 313/112
5,464,462 A * 11/1995 Langer et al. ..... 65/66
5,629,586 A * 5/1997 Yasuda et al. ..... 315/46

FOREIGN PATENT DOCUMENTS

JP 55-165561 12/1980 ..... H01J/61/32
JP 63-168934 7/1988 ..... H01J/9/42

* cited by examiner

*Primary Examiner*—Michael H. Day
(74) *Attorney, Agent, or Firm*—Merchant & Gould PC

(57) ABSTRACT

A fluorescent lamp includes an arc tube 2 made of a glass, a holder 3 made of a heat-resistant resin for supporting the arc tube, and a case 5 having a base 6 and combined with the holder. The glass of the arc tube has light transmittance of 70% or less with respect to a wavelength of 340 nm, 50% or less with respect to 330 nm, and 15% or less with respect to 310 nm. The glass suppresses vaporization of the resin of the holder due to heat and ultraviolet ray emitted from the arc tube, thereby preventing adhesion of scattered resin to the inner surface of a globe of a lighting fixture.

9 Claims, 2 Drawing Sheets

FLUORESCENT LAMP WITH HOLDER MADE OF RESIN

FIELD OF THE INVENTION

The present invention relates to a fluorescent lamp and a fluorescent lamp apparatus.

BACKGROUND OF THE INVENTION

With regard to a conventional bulb-shaped fluorescent lamp or a compact fluorescent lamp or the like, structures like those disclosed, for example, in JP58(1983)-21379B, JP6(1992)-30221B and so forth are known. In these structures, a small-dimensioned arc tube formed by bending a glass tube once or twice into a U-shape or interconnecting glass tubes by a bridge is used. The arc tube is supported by a holder made of a heat-resistant resin and is combined with a case having a base and housing a lighting circuit, and furthermore, a glass globe or a resin globe is mounted over the arc tube. As the heat-resistant resin forming the holder, for example, polybutylene terephthalate (PBT), polyethylene terephthalate (PET), polycarbonate (PC) or the like are used.

A fluorescent lamp without a globe is incorporated into an enclosed lighting fixture or a partially open type lighting fixture for use. Also a fluorescent lamp with a globe is often used in combination with the above-mentioned lighting fixtures.

In the conventional fluorescent lamp mentioned above, there was a problem that fogging occurred on the inner surface of the globe or the lighting fixture before the end of its lifetime, thereby causing reduction of emission beams and deterioration of luminous maintenance characteristics. In particular, such a problem became apparent for a fluorescent lamp with a high tube wall load.

As a result of investigating the cause for this problem, it became clear that the holder made of resin supporting the arc tube was vaporized and scattered partially by the effect of heat and a trace of ultraviolet rays emitted from the arc tube, which adhered to the inner surface of the globe or the lighting fixture in a form of smoke.

SUMMARY OF THE INVENTION

It is an object of this invention to solve the problem of the conventional fluorescent lamp, and to prevent the reduction of beams and improve the luminous maintenance factor.

A fluorescent lamp of the present invention includes an arc tube made of glass, a holder made of a heat-resistant resin for supporting the arc tube, and a case having a base combined with the holder. The glass of the arc tube has light transmittance with characteristics of 70% or less with respect to a wavelength of 340 nm, 50% or less with respect to 330 nm, and 15% or less with respect to 310 nm.

According to the glass of the arc tube, the transmittance of ultraviolet rays emitted from the arc tube is suppressed in a wavelength region of 310 nm to 350 nm. Therefore, even if the compact high output arc tube partially has a high tube wall temperature during lighting, the decomposition and the scatter of the resin components of the holder can be suppressed, and thus, the effect of preventing the reduction of emission beams or the deterioration of the luminous maintenance factor can be obtained.

In the above-mentioned configuration, it can be configured such that the arc tube has a structure in which a discharge path is formed by interconnecting a plurality of glass tubes.

Furthermore, in the above-mentioned configuration, it can be configured such that the arc tube at least partially has a tube wall temperature of 80° C. or more during lighting, and that the arc tube is covered with a globe made of glass or resin.

A fluorescent lamp apparatus of the present invention contains any one of the fluorescent lamps of the configuration mentioned above in an enclosed appliance.

Furthermore, another configuration of a fluorescent lamp apparatus of the present invention contains any one of the fluorescent lamps of the configuration mentioned above in a partially open type lighting fixture.

DESCRIPTION OF THE PREFERRED EMBODIMENTS

Figure 1:
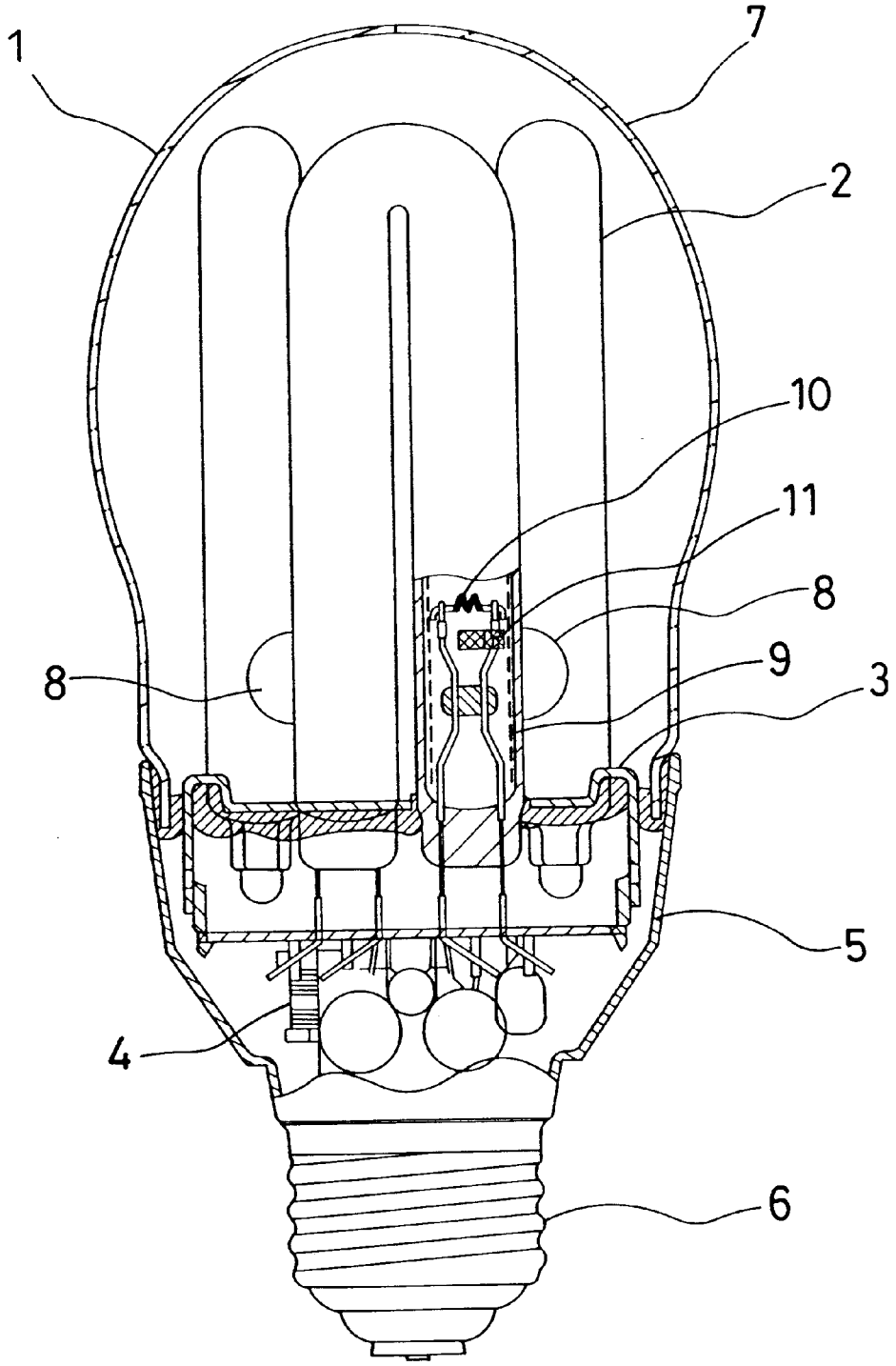
FIG. 1 is a front view partially shown in cross section of a fluorescent lamp according to an embodiment of the present invention.

In the following, an embodiment of the present invention will be explained by referring to the drawings.

FIG. 1 shows an example of a fluorescent lamp of the present invention, which is a front view shown partially in cross section. A fluorescent lamp 1 includes an arc tube 2, a holder 3 made of a heat-resistant resin, a case 5 made of a heat-resistant resin for housing a lighting circuit 4, a base 6 and a globe 7 made of glass. The arc tube 2 is formed by bending a glass tube made of a soda glass etc. into a U-shape and interconnecting by a bridge so as to form one discharge path. 8 denotes a bridge part for connecting the sections of the arc tube 2. The inner surface of the arc tube 2 is coated with a phosphor 9. In the arc tube 2, a predetermined amount of mercury, rare gas such as argon, and an amalgam forming substance for controlling mercury vapor pressure are filled or deposited. At tube ends of the arc tube 2, a pair of electrodes 10 (only one side is shown) is provided. Further, an indium-based amalgam forming substance 11 for an auxiliary use also is deposited in the tube.

As for the glass of the arc tube forming the arc tube 2, a material whose light transmittance shows the characteristics of 70% or less with respect to a wavelength of 340 nm, 50% or less with respect to 330 nm, and 15% or less with respect to 310 nm was used.

In the following, a specific example of the present invention will be explained.

Four pieces of glass tubes with 10 mm in inner diameter bent into a U-shape were connected to create the arc tube 2 having a discharge path of 480 mm as a distance between electrodes. Furthermore, the base 6 was attached to the case 5 made of PBT resin, and the lighting circuit 4 was combined with the arc tube 2. In addition, the glass globe 7 provided with a diffusion film was mounted to create the fluorescent lamp 1 shown in FIG. 1, which was used for the experiment.

This fluorescent lamp 1 has a total length of 140 mm, a maximum diameter of 65 mm, and 22 W rated power. As the arc tube 2, the following glasses respectively were used for the experimental products.

(A) Soda glass whose light transmittance is 40% with respect to 340 nm, 20% with respect to 330 nm, and 6% with respect to 310 nm.

(B) Soda glass whose light transmittance is 70% with respect to 340 nm, 50% with respect to 330 nm, and 15% with respect to 310 nm.

(C) Soda glass whose light transmittance is 80% with respect to 340 nm, 65% with respect to 330 nm, and 30% with respect to 310 nm.

(D) Soda glass whose light transmittance is 85% with respect to 340 nm, 75% with respect to 330 nm, and 50% with respect to 310 nm.

The light transmittance of the fluorescent lamp can be changed, for example, by variously changing the content of $CeO_2$ in the soda glass. Specifically, the content of $CeO_2$ in each of the above-mentioned soda glasses is 0.2 weight % for (A), 0.04 weight % for (B), 0.02 weight % for (C), and 0 weight % for (D).

A predetermined amount of the ordinary phosphor 9 having three wavelength region emission characteristics of 5000 K color temperature was coated on the inner wall of the glass tube of the arc tube 2. At its tube end, a pair of tungsten coil electrodes 10 were provided. A predetermined amount of argon, Hg—Bi—Sn amalgam and the indium-based amalgam forming substance 11 for an auxiliary use also were filled in the arc tube 2.

Figure 2:
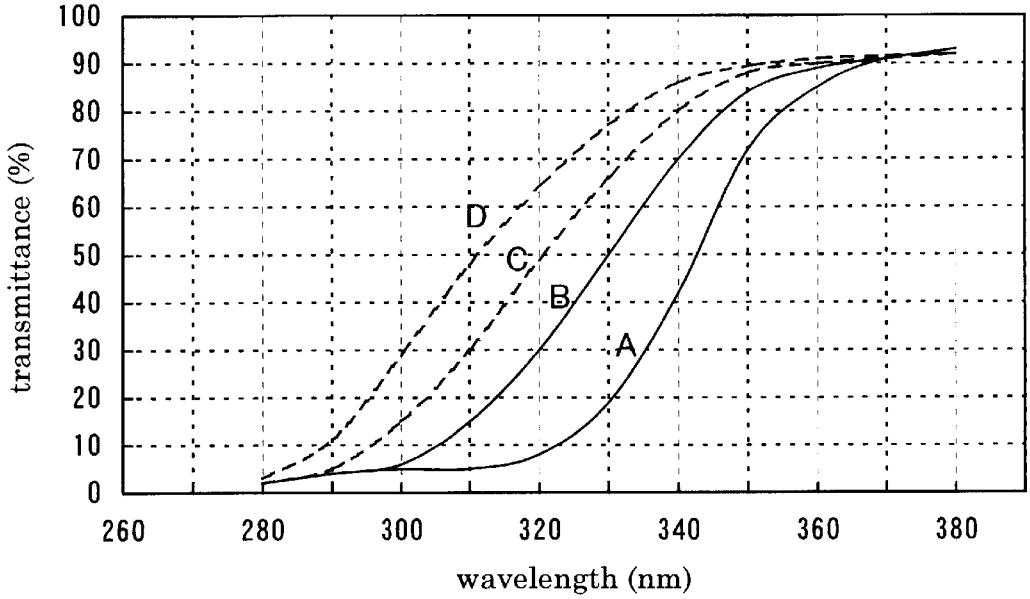
FIG. 2 is a graph showing characteristics of light transmittance in a specific wavelength region of a glass tube for an arc tube.
Figure 3:
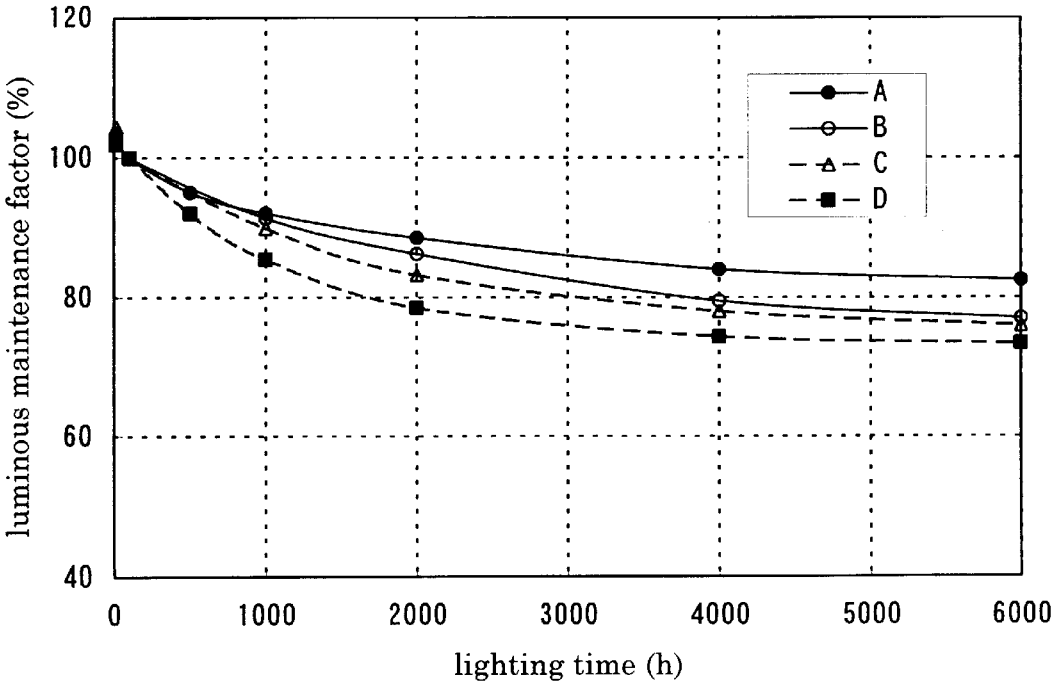
FIG. 3 is a graph showing luminous maintenance characteristics of a fluorescent lamp.

The fluorescent lamps (A), (B), (C), (D) with the arc tube 2 made of the glasses whose light transmittance in the emission range of ultraviolet rays was changed as described above were used for the lighting experiments. As a result, the characteristics shown in FIG. 2 and FIG. 3 were obtained. FIG. 2 shows the light transmittance of the glass tubes in a specific wavelength region of the experimental fluorescent lamps. FIG. 3 shows the luminous maintenance characteristics of the fluorescent lamps using the glass tubes shown in FIG. 2.

As it is clear from FIG. 3, compared to the experimental fluorescent lamps (C), (D), the experimental fluorescent lamps (A) and (B) have superior luminous maintenance characteristics. When the inner surface of the glass globe was examined at the time when it was lighted for 3000 hours, it became clear that the resin components of the holder etc. included in the fluorescent lamp were scattered due to the effect of heat and ultraviolet rays in the cases of (C) and (D), thereby forming a cloudy coating on the inner surface of the globe. On the other hand, such a cloudy coating was not found in the cases of (A) and (B). Therefore, it can be said that the luminous maintenance characteristics deteriorated in (C) and (D) because the globe became cloudy.

In addition, the temperature of the arc tube during lighting was measured at the time of the lighting experiments mentioned above. The result was that in the vicinity of the central part of the arc tube, the outer wall temperature of the tube was 170° C. during lighting when the base is positioned upward, and also the surface temperature of the holder part was 150° C., so that the lighting had proceeded continuously in a high temperature state.

Based on the above results, various tests were conducted. For example, for lighting experiments in an enclosed state of the arc tube, the same materials as those of the arc tube glasses (A), (B), (C), (D) used for the above experiments were used to create fluorescent lamps of a shape shown in FIG. 1 without a globe, and the fluorescent lamps were arranged inside enclosed lighting fixtures used for ordinary electric bulbs. As a result of conducting the lighting experiments under conditions of a high temperature atmosphere where the holder temperature partially reached 140° C. or higher, it was confirmed that (A) and (B) did not cause fogging of the lighting fixture and therefore were superior in practical use to (C) and (D), similarly to the above-mentioned experiments.

Furthermore, an experiment was conducted in which a fluorescent lamp with a globe was mounted on a partial open type lighting fixture and a liquid crystal polymer or polyetherimide was used as the resin material of the holder. As a result, it was confirmed that the effect of improving the luminous maintenance characteristics can be obtained by selecting the blocking characteristics of the glass of the arc tubes against ultraviolet rays as described above. In other words, it became clear that it is possible to prevent the decomposition and the scatter of the resin components of the holder caused by the interaction of the high temperature atmosphere and the ultraviolet rays.

In addition, the fluorescent lamp of the present invention is not limited to the embodiment described above or to the shape, size, design, rating, material or the like described in the embodiment, but is capable of selecting each factor widely for its application, and the present invention is freely applicable to various types of fluorescent lamps.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A fluorescent lamp comprising an arc tube made of glass, a holder made of a heat-resistant resin for supporting the arc tube, and a case having a base and combined with the holder, wherein the glass of the arc tube has light transmittance of 70% or less with respect to a wavelength of 340 nm, 50% or less with respect to 330 nm, and 15% or less with respect to 310 nm.

2. The fluorescent lamp according to claim 1, wherein the arc tube has a structure in which one discharge path is formed by interconnecting a plurality of glass tubes.

3. A fluorescent lamp apparatus containing the fluorescent lamp according to claim 2 in an enclosed lighting fixture.

4. A fluorescent lamp apparatus containing the fluorescent lamp according to claim 2 in a partial open type lighting fixture.

5. The fluorescent lamp according to claim 1, wherein the arc tube at least partially has a tube wall temperature of 80° C. or more during lighting, and the arc tube is covered with a globe made of glass or resin.

6. A fluorescent lamp apparatus containing the fluorescent lamp according to claim 5, in an enclosed lighting fixture.

7. A fluorescent lamp apparatus containing the fluorescent lamp according to claim 5, in a partial open type lighting fixture.

8. A fluorescent lamp apparatus containing the fluorescent lamp according to claim 1 in an enclosed lighting fixture.

9. A fluorescent lamp apparatus containing the fluorescent lamp according to claim 1 in a partial open type lighting fixture.

* * * * *